US006838426B1

(12) United States Patent
Zeilinger

(10) Patent No.: US 6,838,426 B1
(45) Date of Patent: Jan. 4, 2005

(54) COMPOSITIONS FOR WATER-BASED AND SOLVENT-BASED SPRAYABLE GELS AND METHODS FOR MAKING SAME

(75) Inventor: Scott Zeilinger, Pepper Pike, OH (US)

(73) Assignee: Magic American Products, Inc., Cleveland, OH (US)

( * ) Notice: Subject to any disclaimer, the term of this patent is extended or adjusted under 35 U.S.C. 154(b) by 212 days.

(21) Appl. No.: 10/161,485

(22) Filed: May 31, 2002

(51) Int. Cl.[7] ..... C11D 7/50; C11D 17/00

(52) U.S. Cl. ..... 510/417; 510/238; 510/365; 510/421; 510/424; 510/437; 510/506

(58) Field of Search ..... 510/365, 417, 510/421, 424, 505, 506, 437, 432, 238, 101, 429, 426

(56) References Cited

U.S. PATENT DOCUMENTS 4,306,989 A 12/1981 Motsenbocker
4,315,828 A 2/1982 Church
4,362,638 A * 12/1982 Caskey et al. ..... 510/284
5,330,673 A 7/1994 Bayless
5,523,014 A * 6/1996 Dolan et al. ..... 510/396
5,525,254 A 6/1996 Reininger
5,705,470 A 1/1998 Faris
5,968,888 A * 10/1999 Blandiaux ..... 510/396
5,977,036 A * 11/1999 Guskey ..... 510/121
5,977,050 A 11/1999 Faris
6,156,711 A * 12/2000 Perlman ..... 510/118
6,194,372 B1 2/2001 Picken, Jr. et al.
6,624,125 B2 * 9/2003 Trage et al. ..... 510/101

* cited by examiner

*Primary Examiner*—Gregory Webb
(74) *Attorney, Agent, or Firm*—Benesch, Friedlander, Coplan & Aronoff LLP

(57) ABSTRACT

The present invention is a sprayable gel cleaning composition and a method of making said sprayable gel cleaning composition. The gel stays on the stained surface until it is wiped off, unlike non-gelatinous compositions that have a very short surface contact time. The active agents of the sprayable gel cleaning composition are in contact with the stain for a longer period of time than other cleaners. The sprayable gel cleaning composition can be used to remove household and industrial spots and stains that are present on walls, cabinets, stove tops, doors, and trim. In addition, this invention can be used to clean concrete and brick, and remove caulk and paint from surfaces, as well as remove bug and tar stains present on automobiles, trucks, and other machinery and surfaces. The gelatinous composition may be water-based or solvent-based.

32 Claims, No Drawings

COMPOSITIONS FOR WATER-BASED AND SOLVENT-BASED SPRAYABLE GELS AND METHODS FOR MAKING SAME

BACKGROUND OF THE INVENTION

Household and industrial spots and stains are unattractive and can damage paint finishes on household surfaces, automobiles, trucks, machines, wood, siding, and other surfaces. It is desirable to clean these types of stains in an economical manner. Many spray cleaners have limited contact times because they tend to run down the surface and/or the solvent may evaporate, with the concomitant result of limited contact time.

The limited contact time of other cleaners decreases their effectiveness because the active ingredients are not given enough time to break down the stain. As a result of the limited contact time, numerous applications are required to clean the stain. Moreover, because other cleaners run, the stain can be spread, and streaks may be left even after the cleaning.

U.S. Pat. No. 4,315,828, to Church describes a use of a cleaning compound composed mainly of water and a minor cleaning component such as ammonium hydroxide or a lower alcohol.

U.S. Pat. No. 5,330,673, to Bayless describes the use of a cleaning compound that is composed of 80–97.5% d-Limonene and 2.5–20% of cocamide DEA/dihexyl sodium sulfosuccinate.

U.S. Pat. No. 5,525,254, to Reininger describes a use of a cleaning compound that is composed mainly of toluene and xylene.

The present invention is directed to a cleaner that is expelled from the container in gelatinous form, which, upon contact with a surface, is capable of retaining its gelatinous form. The sprayable gel cleaning solution is atomized during spraying, thereby allowing the spayed solution to contact a larger surface area. The ability of the gel solution to atomize during spraying offers the user of the product to benefit from different spraying options. For example, the user of the sprayable gel solution may set the sprayer nozzle on a stream setting to allow the solution to contact only limited portion of the surface. Alternatively, the spray nozzle can be adjusted to spray the atomized gel solution onto a wider surface area.

The gel material of the present invention is advantageous in that instead of evaporating quickly or running off, it allows extended contact time with the dirty and/or stained surface, thereby more quickly and effectively breaking down the stain and cleaning the surface. The sprayable gel cleaning solution disclosed herein is more effective than conventional liquid cleaning solutions. Conventional liquid cleaning solutions break up a stain, however, when the user wipes up the stained area, the stain tends to spread into cracks and crevices. Therefore, a second application of the liquid solution may often be necessary to completely remove the stain and clean the surface that has been effected. The present invention, because it is in a gelatinous form, dissolves the stain and holds the stain in the gel formulation. As a result, when the stain-holding solution is wiped up, the stain is not spread over the surface, into cracks and crevices. Therefore, the present invention allows for easier and more efficient cleaning of a stained surface and minimizes the need for second and subsequent applications of the solution to completely clean the stained area. It is to meet this and other heretofore unmet needs that the present invention is directed.

SUMMARY OF THE INVENTION

One embodiment of the present invention discloses a sprayable gel cleaning composition. The sprayable cleaning gel includes a surfactant, a solvent, and a gelling agent. The sprayable gel cleaning composition is effective in removing both lipophilic and hydrophobic stains.

In one embodiment, the sprayable gel cleaning composition is water-based. In an alternative embodiment, the sprayable cleaning gel is organic-based.

The water-based sprayable gel cleaning composition embodiment also includes ethyl butyrate. The ethyl butyrate preferably comprises about 0.06% by weight of said gel cleaning composition. The gelling agent used in the water-based sprayable cleaning gel embodiment is an acrylic polymer. The gelling agent preferably comprises about 0.15% by weight of said gel cleaning composition. The surfactant used in the water-based sprayable cleaning gel composition is preferably about 0.5% by weight of said gel cleaning composition. The solvent used in the water-based gel composition is about 25% by weight of said gel cleaning composition.

In one embodiment, the water-based sprayable gel cleaning composition includes deionized water. The deionized water preferably comprises about 73.56% by weight of said gel cleaning composition.

In another embodiment, the water-based sprayable gel cleaning composition, further includes a terpene. The terpene makes up about 0.5% by weight of the gel cleaning composition.

The water-based sprayable get cleaning composition, in another embodiment, includes an amino alcohol. The amino alcohol preferably comprises about 0.17% of said gel cleaning composition.

In an alternative embodiment, the sprayable gel cleaning composition, also includes a microbicide. The microbicide preferably comprises about 0.06% by weight of said gel cleaning composition.

In the organic-based gel sprayable gel cleaning composition, the gelling agent is preferably a modified polysaccharide. In this embodiment, the gelling agent preferably comprises about 25% by weight of said gel cleaning composition.

In another embodiment, the organic-based gel cleaning composition includes mineral oil. The mineral oil preferably comprises about 57% by weight of said gel cleaning composition.

In yet another embodiment, the organic-based sprayable gel cleaning composition includes a terpene. The terpene preferably comprises about 13% by weight of said gel cleaning composition.

The surfactant used in the organic-based gel cleaning composition comprises about 5% by weight of said gel cleaning composition.

The organic-based sprayable gel cleaning composition, in another embodiment, includes a dye. The dye comprises preferably about 0.00018% by weight of said gel cleaning composition.

In another embodiment, the organic-based sprayable gel cleaning composition includes a mineral spirit. The mineral spirit preferably comprises about 81% by weight of the gel cleaning composition.

In another embodiment, the sprayable gel cleaning composition includes LGB. The LGB preferably comprises about 0.52% by weight of said gel cleaning composition. In another embodiment of the present invention, a method for the preparation of a sprayable gel cleaning composition is disclosed. In this embodiment, the method fore preparation includes the combining and mixing a surfactant, a solvent, and a gelling agent. In another embodiment of the present invention, a method for the removal of lipophilic and hydrophobic stains and substances from a household and industrial surface is disclosed. The method of this embodiment includes spraying a gel composition onto a surface, allowing the gel composition to have sufficient contact time with the surface; and wiping any excess gel composition off of the surface. In this method, the gel composition that is preferably used includes a surfactant, a solvent, and a gelling agent. The gel composition used in accordance with this method may be water-based or organic-based. In the water-based embodiment of this method, the gel composition preferably used includes ethyl butyrate. Furthermore, the gelling agent preferably used with the water-based gel composition is an acrylic polymer. In the organic-based embodiment of this method the gelling agent is preferably a modified polysaccharide.

DETAILED DESCRIPTION OF THE PREFERRED EMBODIMENTS

The present invention is generally a sprayable gel cleaning composition. The present invention can be used to clean household and industrial spots and stains that are present on walls, cabinets, stove tops, upholstery, brick, concrete, doors, trim, automobiles and trucks. In addition, the sprayable gel cleaning solution may be used to remove adhesives, caulk, soot, and ink from many surfaces, as well as clean bug and tar stains present on automobiles, trucks, construction machinery and other machinery that becomes stained. In a preferred embodiment of the present application, the water-based embodiments of the sprayable gel composition can be used to remove paint from a variety of surfaces.

Unlike many other cleaners that have limited contact times, the present invention has an extended contact time without running. This is advantageous because the active agents in the cleaning composition remain in contact with the stain for a longer period of time, thus able to break down the stain with fewer applications and less effort on the part of the user of the cleaner. Further, the gel material retards evaporation and is therefore useful even on hot surfaces, such as those of an automobile or stove top.

The cleaning composition described herein is in the form of a gel while in its dispensing container. Upon activating the spray bottle to dispense the contents, the gel is sprayed onto the stain. The gel does not run or cause streaking, and the gel stays on the stained surface until it is wiped off. Thus, the active agents of the sprayable gel cleaning composition are in contact with the stain for a longer period of time than other cleaners. Moreover, the gel solution does not clog the sprayer.

One embodiment of the present invention is a water-based sprayable gel cleaning composition. This water-based gel solution does not irritate the skin, it has low VOCs, it is not an inhalation hazard, and it is non-flammable, thereby making the composition safer for consumer use. Moreover, the water-based gel solution can be used to remove many types of surface stains, as well as other substances and coatings applied to surfaces, such as caulk and paint. In addition, this embodiment of the present invention may be used to remove lipophilic and hydrophobic stains.

The water-based sprayable gel cleaning composition is preferably comprised of a polar solvent. The solvent that is used in the preferred embodiment is glycol ether, particularly, EB Ethylene Glycol Butyl Ether, produced by DOW Chemical under the trademark DOWANOL®. Other solvents include, but are not limited to, the following: glycols, alcohols, dibasic esters, and other polar solvents. Additionally, solvents also include, but are not limited to, the following: ethylene glycol monomethyl ether, ethylene glycol butyl ether, diethylene glycol monomethyl ether, diethylene glycol monobutyl ether, propylene glycol phenyl ether, propylene glycol monomethyl ether, propylene glycol monopropyl ether, dipropylene glycol monopropyl ether, propylene glycol monobutyl ether, dipropylene glycol monobutyl ether, ethylene glycol, diethylene glycol, triethylene glycol, tetraethylene glycol, propylene glycol, dipropylene glycol, hexylene glycol, 1,2,6 hexanetriol, 1,5 pentanediol, methyl alcohol, ethyl alcohol, ethylene glycol ethyl ether, ethylene glycol isopropyl ether, diethylene glycol ethyl ether, dipropylene glycol methyl ether, tripropylene glycol methyl ether, propyl alcohol, isopropyl alcohol. The solvent comprises about 5% to about 50% by weight of the water-based sprayable gel, more preferably about 15% to about 40% by weight, and even more preferably about 20% to about 30% by weight, and even more preferably about 25% by weight of the sprayable gel cleaning composition.

In an alternative embodiment, the water-based sprayable cleaning solution comprises the solvent acetone. The solvent comprises about 5% to about 50% by weight of the water-based sprayable gel, more preferably about 15% to about 40% by weight, and even more preferably about 20% to about 30% by weight, and even more preferably about 25% by weight of the sprayable gel cleaning composition.

The water-based sprayable gel cleaning composition preferably includes at least one surfactant. Surfactants can be any ethoxylated alcohol, and include, but are not limited to, nonionic surfactants and anionic surfactants. The surfactant that is used in the preferred embodiment is commercially known as Tomadol 1-7. Many surfactants are listed in McCutcheon's Emulsifiers and Detergents 1999: North American Edition, Vol. 1, which is hereby incorporated by reference in its entirety. Preferably, the surfactant preferably comprises about 0.01% to about 5%, even more preferably about 0.1% to about 1%, and even more preferably about 0.5% by weight of the water-based sprayable gel cleaning composition.

In a preferred embodiment of the present invention, the water-based sprayable gel cleaning composition includes at least one acrylic polymer for thickening. One example of an acrylic polymer used for thickening, and also that which is used in the preferred embodiment, is marketed under the trademark CARBOPOL® EZ-3 Polymer, manufactured by BF Goodrich Performance Materials. Carbopol® polymers are high molecular weight, crosslinked, acrylic acid-based polymers. Carbopol® homopolymers are polymers of acrylic acid crosslinked with allyl sucrose or allylpentaerythritol. Carbopol®copolymers are polymers of acrylic acid, modified by long chain (C10-C30) alkyl acrylates, and crosslinked with allylpentaerythritol. The acrylic polymer preferably comprises about 0.05% to about 10% by weight of the gel cleaning composition, more preferably about 0.10% to about 5% by weight of the gel cleaning compositions, even more preferably about 0.15% by weight of the water-based sprayable gel cleaning composition.

The water-based sprayable gel cleaning composition comprises ethyl butyrate. The ethyl butyrate preferably comprises about 0.001% to about 6% by weight of the gel composition, more preferably about 0.01% to about 1% by weight of the gel composition, even more preferably about 0.05% to about 0.50% by weight of the gel composition, even more preferably about 0.06% by weight of the water-based sprayable gel cleaning composition.

In a preferred embodiment of the present invention, the water-based sprayable gel cleaning composition comprises at least one terpene. Orange oil, a preferred terpene used in the present invention, is a cold pressed volatile oil chemical extracted from orange peels during the juicing process. It has a high solvency and attractive citrus odor. In the preferred embodiment, Orange Oil, 10 fold is used. Orange oil is approximately 90% d-Limonene. Therefore, in an alternative embodiment, d-Limonene or its functional equivalent may be substituted for Orange Oil. The terpene comprises about 0.01% to about 5%, even more preferably about 0.1% to about 1%, even more preferably about 0.5% by weight of the water-based sprayable gel cleaning composition.

In yet an even more preferred embodiment of the present invention, the water-based sprayable gel cleaning composition includes at least one amino alcohol. The amino alcohol used in the preferred embodiment is 2-amino-2-methyl-1-propanol, manufactured by ANGUS Chemical Company under the trademark AMP-95®. The amino alcohol comprises about 0.01% to about 5%, even more preferably about 0.1% to about 1%, even more preferably about 0.15% to about 0.3%, even more preferably about 0.17% by weight of the water-based sprayable gel cleaning composition.

The water-based sprayable gel cleaning composition generally includes at least one microbicide. The microbicide/biocide used in the preferred embodiment of the present invention is methychloroisothiazolone or methylisothiazolone, sold under the trademark Kathon® CG-ICP II Biocide. The microbicide comprises about 0.001% to about 6% by weight of the gel composition, more preferably about 0.01% to about 1% by weight of the gel composition, even more preferably about 0.05% to about 0.50% by weight of the gel composition, even more preferably about 0.06% by weight of the water-based sprayable gel cleaning composition.

In a preferred embodiment, a water-based sprayable gel cleaning solution includes a surfactant, solvent, and gelling agent. In another preferred embodiment, a water-based sprayable gel cleaning solution includes deionized water, EB glycol ether, Tomadol 1-7, Orange Oil (10 fold), AMP-95, Carbopol EZ-3, Kathon CG/ICP II, and ethyl butyrate.

In a preferred embodiment, the method for making the water-based sprayable gel includes the addition and mixing of water, at least one surfactant, at least one solvent, and at least one gelling agent.

In a preferred embodiment, the water-based sprayable gel cleaning composition is composed of about 73.56% by weight deionized water; about 25% by weight EB glycol ether; about 0.5% by weight of Tomadol 1-7; about 0.5% by weight Orange Oil, 10 fold; about 0.17% by weight AMP-95; about 0.15% by weight Carbopol EZ-3; about 0.06% by weight Kathon CG/ICP II; and about 0.06% by weight ethyl butyrate.

In one example of the preferred embodiment, the water-based sprayable gel cleaning composition is made by charging the deionized water. The water is kept in a clean mixing vessel, preferably at a temperature of less than 60° F. The mixing vessel is preferably made of stainless steel construction. Further, in the preferred embodiment, the mixing vessel is equipped with a variable speed mixer and vertical baffles. Carbopol EZ-3 powder is added to the top of the water, but is not stirred into the water. Once the Carbopol powder sinks into the water, an agitator is turned on at slow speed. The solution is mixed until the Carbopol powder is dissolved and dispersed, thereby creating a clear solution. EB glycol ether is added to the water/Carbopol solution, then, Tomadol 1-7 is added and ethyl butyrate is added, accompanied by continuous mixing at slow speed. AMP-95 is carefully weighed and added to the remaining mixture. At this point, the agitator speed may be increased in order to obtain good mixing. The pH of the mixture is adjusted to 8.3–8.5. Kathon CG/CP II is added to the mixture and the resulting mixture is then agitated for an additional 10 minutes. At this point, the pH should be tested to insure that it is at the preferred range of 8.3–8.5. A water-based sprayable gel cleaning composition is created by following the method discussed above.

The advantages of the water-based sprayable gel cleaning composition of the present invention include the characteristic that it is not a skin-irritant, it has very low VOCs, it is not an inhalation hazard and it is non-flammable at low temperatures. Its improved performance and efficacy as compared to other competing products are presented in Tables 1–3 below.

TABLE 1

Pro Power vs. Commercial Product 1
Approximate Percent Removal of

| | Commercial Product 1 (water-based dried latex paint remover) | Pro-Power | Percent Increased Removal |
|---|---|---|---|
| Stains | | | |
| Pencil | 50 | 60 | +20% |
| Black Ballpoint Ink | 30 | 50 | +67% |
| Elmer's Glue | 1 | 10 | +900% |
| Coatings | | | |
| Varnish (Dried 8 hrs on painted metal) | 5 | 85 | +1600% |
| Latex (Dried 8 hrs on wood) | 40 | 50 | +25% |
| Caulk Loosening | | | |
| Acrylic | SLIGHT | YES | |
| Labels | | | |
| Removal-Laminate off | FAIR | GOOD | |

TABLE 2

Pro Power vs. Commercial Product 2
Approximate Percent Removal of Stains

| | Commercial Product 2 (Water-based paint and stain remover) | Pro-Power | Percent Increased Removal |
|---|---|---|---|
| Stains | | | |
| Shoe Polish | <1 | 20 | +1900% |
| Nail Polish | <1 | 10 | +900% |
| Red Marker | 30 | 75 | +150% |
| Black Marker | <5 | 50 | +900% |
| Lipstick | 15 | 25 | +67% |
| Blue Ballpoint Pen | 40 | 60 | +50% |
| Ink Pad Ink | 50 | 80 | +60% |
| Household Grease | 50 | 75 | +50% |
| Automobile Grease | 25 | 60 | +140% |
| Coatings | | | |
| Acrylic Paint (Dried 8 hrs on wood) | 40 | 50 | +25% |
| Acrylic Paint (Dried 24 hrs on wood) | 40 | 50 | +25% |

TABLE 2-continued

Pro Power vs. Commercial Product 2
Approximate Percent Removal of Stains

| | Commercial Product 2 (Water-based paint and stain remover) | Pro-Power | Percent Increased Removal |
|---|---|---|---|
| Varnish (Dried 8 hrs on painted metal) | 0 | 85 | Infinite % Better |
| Lacquer (Dried 8 hrs on painted metal) | 0 | 65 | |
| Lacquer (Dried 8 hrs on painted metal) | <1 | 45 | +4400% |
| Latex (Dried 8 hrs on wood) | 40 | 50 | +25% |
| Latex Paint (Dried 24 hrs on wood) | <10 | 40 | +300% |
| Caulk Loosening | | | |
| Acrylic | NONE | YES | |

TABLE 3

Pro Power vs. Commercial Product 3
Approximate Percent Removal of Stains

| | Commercial Product 3 (Water-based paint and stain remover) | Pro-Power | Percent Increased Removal |
|---|---|---|---|
| Stains | | | |
| Glue Stick | 20 | 70 | +250% |
| Pine Resin | <1 | 3 | +200% |
| Black Marker | 40 | 50 | +25% |
| Black Ballpoint Pen | <5 | 50 | +900% |
| Blue Ballpoint Pen | 40 | 60 | +50% |
| Ink Pad Ink | <5 | 80 | +1500% |
| Elmer's Glue | <1 | <10 | +900% |
| Coatings | | | |
| Acrylic Paint (Dried 8 hrs on wood) | 25 | 50 | +100% |
| Acrylic Paint (Dried 24 hrs on wood) | 10 | 50 | +400% |
| Lacquer (Dried 8 hrs on painted metal) | 55 | 65 | +18% |
| Latex Paint (Dried 8 hrs) | <10 | 50 | +400% |
| Latex Paint (Dried 24 hrs) | <10 | 40 | +300% |
| Labels | | | |
| Removal - Laminate off | Poor | Good | |
| Removal - No Laminate | Poor | Good | |

Another embodiment of the present invention is an organic-based sprayable gel cleaning composition. The composition of organic-based sprayable gel cleaning solution is also advantageous in that it is biodegradable and non-toxic. This organic-based gel solution does not irritate the skin, it has low VOCs, it is not an inhalation hazard, and it is non-flammable, thereby making the composition safer for consumer use. Moreover, this preferred embodiment of the present invention may be used to remove lipophilic and hydrophobic stains.

In a preferred embodiment, the method for making the organic-based sprayable gel composition includes the addition and mixing of at least one surfactant, at least one solvent, and at least one gelling agent.

In one example of the preferred embodiment, the organic-based sprayable gel cleaning composition is preferably made by charging a mixing vessel with Witco PD-23. The mixing vessel is preferably explosion-proof, preferably of stainless steel construction. Further, in a preferred embodiment, the mixing vessel is equipped with a variable speed mixer and vertical baffles. Synergel M500 is added to the mixing vessel. Next, add Tomadol 1-5 and 10 Fold Orange Oil. Next, d-Limonene is added, while reserving a portion of the liquid for later use. The mixing vessel is then closed and the mixture is agitated preferably on slow speed for one hour. Using the reserved d-Limonene, Pylakrome Scarlet LX-10048 dye is dissolved and added to the mixture in the vessel. The addition of the dye/d-Limonene solution to the mixture is preferably monitored to insure that the resulting batch matches the color standard for the product produced. A viscosity check will show that all the gelled product has dissolved. In a preferred embodiment, the packaged product is preferably dispensed with explosion-proof equipment in an isolated area with good ventilation.

In another example of the preferred embodiment, the organic-based sprayable gel cleaning composition is preferably made by charging a mixing vessel with 75% of the quantity of mineral spirits that will be used for making the organic-based gel composition. The mixing vessel is preferably explosion-proof and preferably of stainless steel construction. Further, in a preferred embodiment, the mixing vessel is equipped with a variable speed mixer and vertical baffles. The mixing vessel also preferably includes external heating elements or a steam jacket capable of heating the contents thereof to 240° F. and cooling to room temperature. LGB is added to the vessel. The vessel is preferably closed while heating the contents thereof to 240° F. The LGB will dissolve, but if necessary, the heat on the vessel may be raised. The contents of the vessel are mixed at slow speed. The remainder of the mineral spirits are added, along with the Orange Oil (10fold), d-Limonene and Tomadol 1-5, all of which are preferably added without opening the vessel. The contents of the vessel are preferably cooled to ambient temperature. The contents of the vessel are mixed at low speed, and if necessary, may be discontinued overnight. Before packaging the organic-based gel composition, the contents of the vessel are brought to a sheared liquid state, preferably by mixing the contents for about fifteen (15) minutes on medium speed. In a preferred embodiment, the packaged product is preferably dispensed with explosion-proof equipment in an isolated area with good ventilation.

A organic-based sprayable gel cleaning composition is created by the methods discussed above.

An organic-based sprayable gel cleaning composition preferably includes at least one refined mineral oil. One such mineral oil is a technical white oil manufactured by Witco under the trade designation PD-23. A substitute for PD-23 can be Exxon Mobile's Isopar M. In a preferred embodiment, the mineral oil comprises about 40% to about 70%, preferably about 50% to about 60%, even more preferably about 57% by weight of the solvent-based sprayable gel cleaning composition.

In a preferred embodiment, the organic-based sprayable gel cleaning composition is preferably comprised of at least one gelling agent. Gelling agents include polysaccharides. Synergel™ M500 is an example of a gelling and sieving agent. Synergel™ M500 consists of a modified polysaccharide which, when combined with agarose, forms a hydrogen-bonded binary gel system. The gelling agent comprises about 5% to about 45% by weight of the solvent-based gel composition, more preferably about 10% to about 35% by weight of the solvent-based gel composition, even more preferably about 20% to about 30% by weight of the solvent-based gel composition, even more preferably about 25% by weight of the solvent-based gel cleaning composition.

In a preferred embodiment of the present invention, the organic-based sprayable gel cleaning composition is preferably comprises at least one terpene. An example of a terpene includes, but is not limited to, d-Limonene. D-Limonene is a biodegradable solvent that is the main component of the citrus peel. Orange oil is another example of a terpene. Orange oil is a cold pressed volatile oil chemical extracted from orange peels during the juicing process. It has a high solvency and attractive citrus odor. The terpene comprises about 5% to about 25% by weight of the organic-based gel composition, preferably about 10% to about 20% by weight of the organic-based gel composition, even more preferably 13% by weight of the organic-based gel composition.

The organic-based sprayable gel cleaning composition is composed of at least one surfactant. Surfactants include, but are not limited to, nonionic surfactants and anionic surfactants. The surfactant that is used in the preferred embodiment is commercially known as Tomadol 1-7. Many surfactants are listed in McCutcheon's Emulsifiers and Detergents 1999: North American Edition, Vol. 1, which is hereby incorporated by reference in its entirety. Preferably, the surfactant preferably comprises about 0.01% to about 5% by weight of the organic-based gel composition, more preferably about 0.1% to about 1%, by weight of the gel composition and even more preferably about 0.5% by weight of the organic-based sprayable gel cleaning composition.

The organic-based sprayable gel cleaning composition preferably includes a dye. An example of a dye that may be used in accordance with the present invention is Pylakrome Scarlet LX-10048 (formerly known as Pylakrome Bright Red 108971). The dye preferably comprises about 0.00010 to about 1% by weight of the organic-based gel composition, more preferably about 0.00015 to about 0.01% by weight of the organic-based gel composition, even more preferably 0.00018% by weight of the organic-based sprayable gel cleaning composition.

In a preferred embodiment, an organic-based sprayable gel cleaning composition includes a hydrocarbon solvent. Examples of such hydrocarbon solvents include, but are not limited to, liquid mixtures of hydrocarbons distilled from petroleum, coal tar, and natural gas. In a preferred embodiment, the type of hydrocarbon solvent that is used is an odorless mineral spirit produced by Shell Oil Company. Other examples of odorless mineral spirits are those produced by ExxonMobil. The mineral spirit preferably comprises about 60% to about 90% by weight of the organic-based gel composition, more preferably about 75% to about 85% by weight of the organic-based gel composition, even more preferably about 80% by weight of the organic-based sprayable gel cleaning composition.

In a preferred embodiment, an organic-based sprayable cleaning gel composition includes N-luroyl glutamic acid di-n-butylamide (LGB). In the preferred embodiment, the LGB is obtained from Hampshire Chemicals. The LGB comprises about 0.01% to about 5% by weight of the organic-based gel composition, more preferably about 0.1% to about 1%, by weight of the gel composition, even more preferably about 0.5% by weight of the organic-based sprayable gel cleaning composition.

In a preferred embodiment, an organic-based solution includes Witco PD-23, Synergel M500, Florachem d-Limonene, Tomadol 1-5, Orange Oil (10 fold), and Pylakrome Scarlet LX-10048.

In a preferred embodiment, the organic-based sprayable gel cleaning composition comprises about 57% by weight Witco PD-23; about 25% by weight of Synergel M500; about 12.5% by weight of Florachem d-Limonene; about 5% by weight of Tomadol 1-5; about 0.5% by weight of Orange Oil (10 fold); and about 0.00018% by weight of Pylakrome Scarlet LX-10048.

In another preferred embodiment, an organic-based solution includes mineral spirits, Florachem d-Limonene, Tomadol 1-5, LGB, and Orange Oil (10 fold).

In a preferred embodiment, the organic-based sprayable gel cleaning composition comprises about 81% by weight Mineral Spirits; about 12% by weight of Florachem d-Limonene; about 5% by weight of Tomadol 1-5; about 0.52% by weight of LGB; and about 0.5% by weight of Orange Oil (10 fold).

All references and patents referred to herein are incorporated by reference in their entirety by reference thereto. It should also be noted that unless otherwise indicated, as used herein, the term "about" means ±10%.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of the present invention and protected by the following claims.

I claim:

1. A sprayable gel cleaning composition, comprising:

a surfactant;

a solvent;

mineral oil;

a terpene;

a dye;

a mineral spirit; and

N-lauroyl glutamic acid di-n-butlyamide, wherein said sprayable gel cleaning composition is effective in removing both lipophilic and hydrophobic stains.

2. The sprayable gel cleaning composition of claim 1, further comprising ethyl butyrate.

3. The sprayable gel cleaning composition of claim 1, wherein said composition further comprises water.

4. The sprayable gel cleaning composition of claim 1, wherein said surfactant comprises about 0.5% by weight of said gel cleaning composition.

5. The sprayable gel cleaning composition of claim 1, wherein said solvent comprises about 25% by weight of said gel cleaning composition.

6. The sprayable gel cleaning composition of claim 3, further comprising deionized water.

7. The sprayable gel cleaning composition of claim 6, wherein said deionized water comprises about 73.56% by weight of said gel cleaning composition.

8. The sprayable gel cleaning composition of claim 1, wherein said terpene comprises about 0.5% by weight of said gel cleaning composition.

9. The sprayable gel cleaning composition of claim 1, further comprising an amino alcohol.

10. The sprayable gel cleaning composition of claim 9, wherein said amino alcohol comprises about 0.17% of said gel cleaning composition.

11. The sprayable gel cleaning composition of claim 1, further comprising a microbicide.

12. The sprayable gel cleaning composition of claim 11, wherein said microbicide is comprises about 0.06% by weight of said gel cleaning composition.

13. The sprayable gel cleaning composition of claim 2, wherein said ethyl butyrate comprises about 0.06% by weight of said gel cleaning composition.

14. The sprayable gel cleaning composition of claim 1, wherein said mineral oil comprises about 57% by weight of said gel cleaning composition.

15. The sprayable gel cleaning composition of claim 1, wherein said terpene comprises about 13% by weight of said gel cleaning composition.

16. The sprayable gel cleaning composition of claim 1, wherein said surfactant comprises about 5% by weight of said gel cleaning composition.

17. The sprayable gel cleaning composition of claim 1, wherein said dye comprises about 0.00018% by weight of said gel cleaning composition.

18. The sprayable gel cleaning composition of claim 1, wherein said mineral spirit comprises about 81% by weight of said gel cleaning composition.

19. The sprayable gel cleaning composition of claim 1, wherein said terpene comprises about 13% by weight of said gel cleaning composition.

20. The sprayable gel cleaning composition of claim 1, wherein said N-lauroyl glutamic acid di-n-butlyamide comprises about 0.52% by weight of said gel cleaning composition.

21. A gel composition effective to ease removal of lipophilic and hydrophobic material, comprising:

a hydrocarbon solvent;

a terpene in the range of about 0.01% to about 5% by weight of the gel composition;

ethyl butyrate in the range of about 0.001% to about 6% by weight of the gel composition; and a gelling agent in the range of about 5% to about 45% by weight of the gel composition.

22. The gel composition as set forth in claim 21, where the terpene comprises about 0.05% to about 2% by weight of the gel composition.

23. The gel composition as set forth in claim 21, where the terpene comprises about 0.1% by weight of the gel composition.

24. The gel composition as set forth in claim 21, where the ethyl butyrate comprises about 0.01% to about 1% by weight of the gel composition.

25. The gel composition as set forth in claim 21, where the ethyl butyrate comprises about 0.05% to about 0.50% by weight of the gel composition.

26. The gel composition as set forth in claim 21, where the ethyl butyrate comprises about 0.06% by weight of the gel composition.

27. The gel composition as set forth in claim 21, where the gelling agent comprises about 10% to about 35% by weight of the gel composition.

28. The gel composition as set forth in claim 21, where the gelling agent comprises about 10% to about 20% by weight of the gel composition.

29. The gel composition as set forth in claim 21, where the gelling agent comprises about 15% by weight of the gel composition.

30. The gel composition as set forth in claim 21, further comprising a dye capable of adding color to the gel composition.

31. A spray cleaner comprising:

a composition including odorless mineral spirits in the range of about 60% to about 90% by weight of the composition, a gelling agent in the range of about 5% to about 45% by weight of the composition, and ethyl butyrate; and a container configured to selectively eject the composition from the container.

32. The spray cleaner as set forth in claim 31, where the composition further comprises a terpene in the range of about 0.01% to about 5% by weight of the composition.

* * * * *